United States Patent [19]

Lautenschläger et al.

[11] 4,449,689

[45] May 22, 1984

[54] ADJUSTABLE HANGER FOR WALL-HUNG CABINETS AND THE LIKE

[75] Inventors: Karl Lautenschläger, Reinheim; Gerd Viniol, Ober-Mossau, both of Fed. Rep. of Germany

[73] Assignee: Karl Lautenschläger KG, Möbelbeschlagfabrik, Reinheim, Fed. Rep. of Germany

[21] Appl. No.: 276,931

[22] Filed: Jun. 24, 1981

[30] Foreign Application Priority Data

Jun. 25, 1980 [DE] Fed. Rep. of Germany ..... 3023760
Oct. 1, 1980 [DE] Fed. Rep. of Germany ..... 3036984

[51] Int. Cl.[3] ..... F16M 13/00

[52] U.S. Cl. ..... 248/544; 312/247; 312/250

[58] Field of Search ..... 248/544, 489, 295.1, 248/288.1; 312/247, 250

[56] References Cited

U.S. PATENT DOCUMENTS 2,811,243 9/1978 Weinstabel ..... 248/295.1
3,999,822 12/1976 Nagle ..... 312/250
4,369,763 1/1983 Sullivan ..... 312/250

*Primary Examiner*—William H. Schultz
*Assistant Examiner*—Ramon O. Ramirez

[57] ABSTRACT

A hanger which can be fastened to the back wall of a cabinet which is to be mounted on a wall, such as a cupboard or the like, having a casing in which a hook member is adjustably disposed, which has a hook for attachment to a hook or rail provided on the wall. The casing is in the form of a substantially rectangular, shallow box between whose upright sides, a cam holder for holding a cam and the hook member is articulated on a horizontal axis and can be fixed at selected angular positions. The hook member is disposed in the cam holder for displacement in vertical direction. A cam is rotatably mounted in the cam holder and has a spiral groove which is engaged by a projection of the hook member. By rotating the cam, the hook member can be adjusted upwardly or downwardly relative to the mounting part.

25 Claims, 23 Drawing Figures

Figure 1:
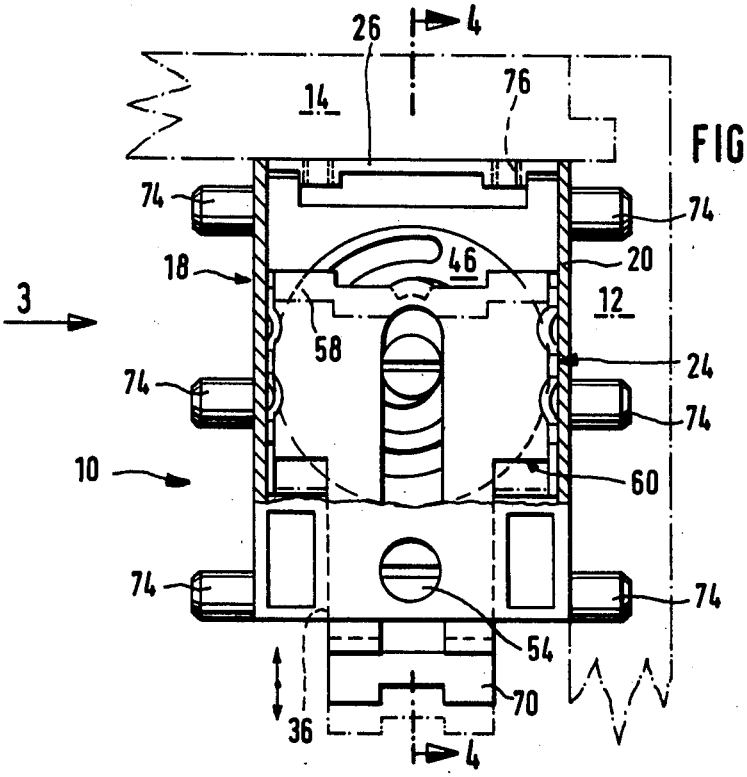

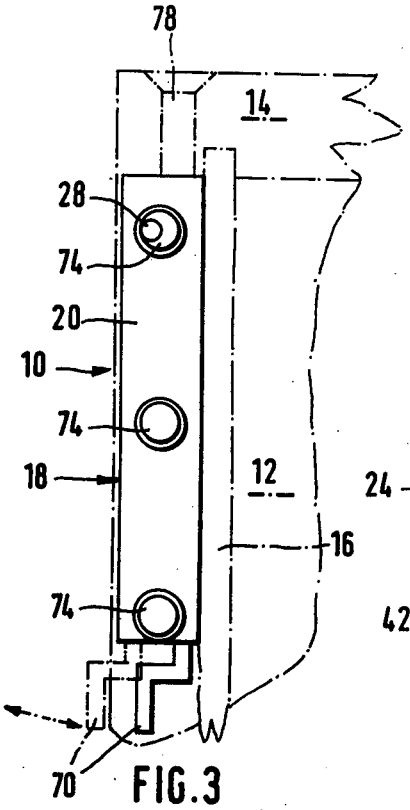
FIG.3
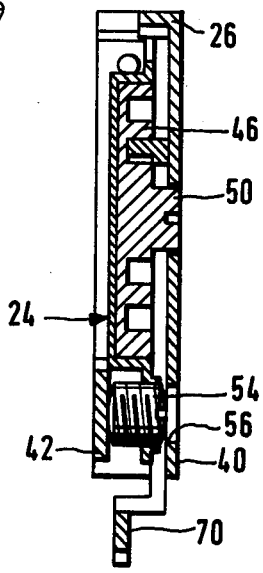
FIG.4
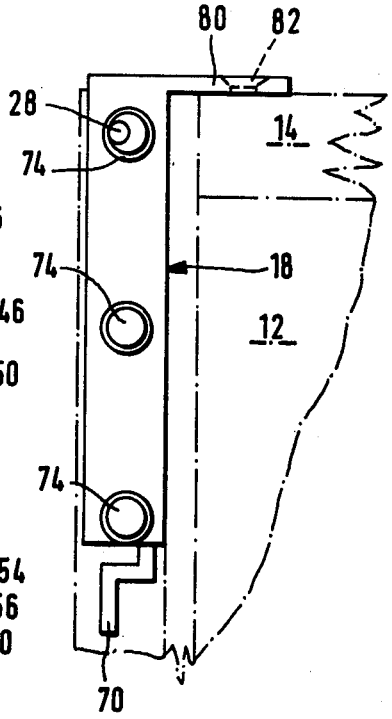
FIG.4a
FIG.13
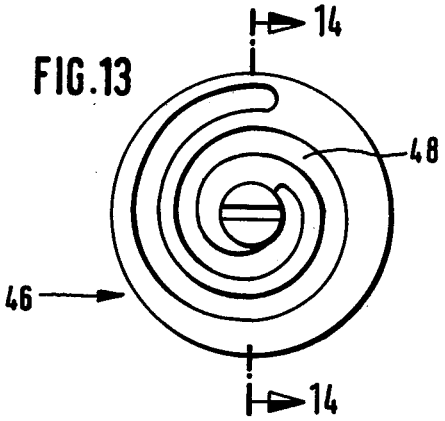
FIG.14
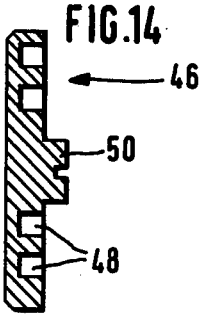

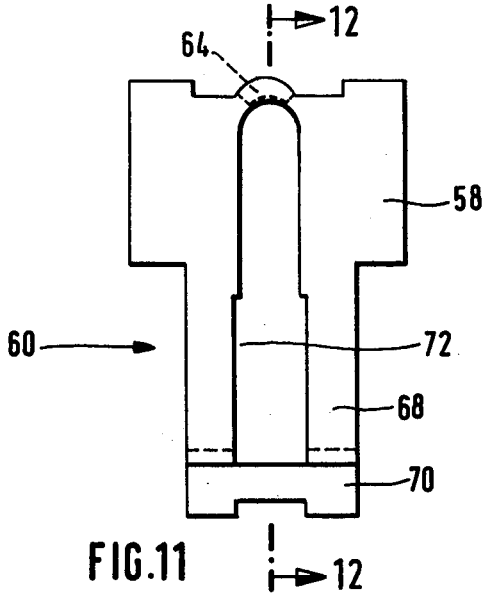
FIG.11
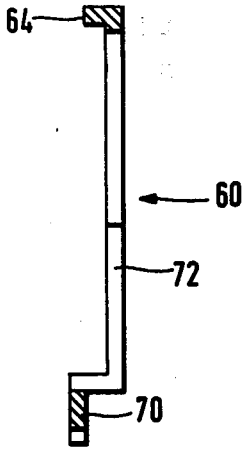
FIG.12
FIG.8
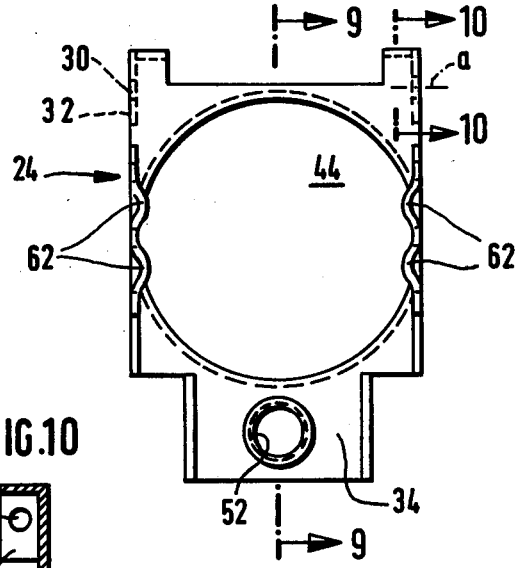
FIG.9
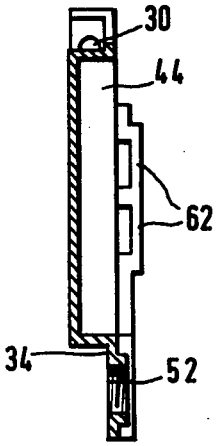
FIG.10
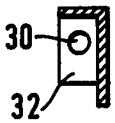

ADJUSTABLE HANGER FOR WALL-HUNG CABINETS AND THE LIKE

BACKGROUND

The invention relates to a hanger for wall-hung cabinets or the like, having a casing which can be fastened in the rearward part of a cabinet and in which a hook member can be hung by means of an end section in the form of a hanging hook onto a wall hook or wall rail is disposed for adjustment at right angles to the wall surface, on the one hand, and parallel to the wall surface on the other.

Hangers of this kind are replacing the formerly common hanging of cabinets on the wall by means of eyes fastened to the rear wall or to the roof of the cabinets, since these had the disadvantage that they provided no means for com-pensating for the imprecise or uneven installation of the wall hooks as far as height is concerned. Furthermore, the precisely flat engagement of the back of the cabinet with the wall could be accomplished only by varying the depth to which the wall hooks were driven, it being necessary for this purpose to remove the cabinet, correct the depth of the hook, and then rehang the cabinet. It was for this reason that hangers of the kind mentioned above were developed, which permit the hanger to be adjusted in the two ways stated, from the interior of the hung cabinet (see, for example, German Pat. No. 1,101,235). These adjustments were achieved, for example, by providing slides guided in the desired directions of adjustment within a substantially closed casing, enabling them to be adjusted by means of screws accessible from outside of the casing, which shifted the hooks projecting through openings in the rear wall of the cabinet. The casings are disposed in the interior of the cabinet, one in each of the upper corners, such that the casing abuts against one side wall of the cabinet and the roof thereof, and can be fastened thereto. The hanger is thus visible in the interior of the cabinet, and furthermore takes away from the depth of the cabinet. Moreover, the distance between the hanger casing and the associated wall hook or hanger rail is relatively great, since the rear wall of wall-hung cabinets is set slightly inwardly from the back edge of the sidewall and roof precisely for the purpose of providing the room required for the hooks or the hanger rails. The forces of gravity acting upon the hardware fastening the casing to the cabinet are therefore applied through a relatively long lever arm, i.e., a relatively strong force tending to tear out the mounting hardware is produced.

THE INVENTION

The invention sets for itself the object of creating a hanger which will be adjustable in the directions stated above and which can be mounted, not in the interior of the cabinet, but in the space existing between the rear wall of the cabinet and the wall, while at the same time making it adjustable from the interior of the cabinet after the latter has been hung.

Setting out from a hanger of the kind mentioned above, this object is achieved in accordance with the invention by the fact that the casing is in the form of a substantially rectangular, shallow box between whose upright sides (when the hanger is in the proper position for fastening) a means for holding a cam and a hook member, which means will be called hereinafter "the cam holder", is mounted so as to be able to pivot about a horizontal axis and to be locked at selectable angular positions, by the fact that the hook member is vertically displaceable on the cam holder and by the fact that a cam mounted for rotation on or in the cam holder between the latter and the hook member and has a spiral groove in its face confronting the hook member, which groove is engaged by a projection of the hook member.

On account of the shallow depth of the box-like casing, it becomes possible to install it in the space between the rear wall of the cabinet and the wall of the room. The articulation of the cam holder permits adjustment of the spacing from the wall, while the engagement of the projection of the hook member in the spiral groove of the cam enables the hook member to be shifted vertically, thus providing for the vertical adjustment.

The holding means is, in an advantageous development of the invention, in the form of a shallow plate which substantially fills the space surrounded by the casing, and it has a recess containing and conforming to the shape of the cam. A flat portion of the hook member is disposed over this recess and is guided in longitudinal guides on the sides of the cam holder such as to be secured against lifting away from the cam holder.

It then becomes expedient to provide the cam, on its side confronting the hook member, with a short, projecting stud suitable for engagement by a tool, this stud passing through a slot disposed in the direction of displacement in the hook member. For the height adjustment it is then necessary only to provide the rear wall of the cabinet with a hole aligned with the stud, having a diameter no greater than is necessary for the introduction of the blade of a screwdriver into the stud. The hole can then be closed up with a plastic plug so as to be almost invisible.

It is desirable for the lower, horizontally disposed side of the casing box to have a vertical opening defined at the front and back by thin, parallel transverse walls, and for a prolongation of the hook member to pass through it, the bottom of the hook member projecting from the casing being in the form of a hook which can be hung on the wall hook or on the hanger rail mounted on the wall.

The cam holder then also has, in further development of the invention, a prolongation also projecting into the vertical opening, and in a threaded bore provided within the vertical opening in the prolongation of the cam holder there is driven the threaded shaft of a screw which passes through the slot in the overlying prolongation of the hook member and has its extremities resting against the inside surfaces of the crosspieces, an opening then being provided in the front crosspiece on the hook member side for engaging the screw. To give access to this screw which permits the angle of the cam holder to be changed, and with it the hook member, it is necessary only to provide a bore in the rear wall of the cabinet, in line with the screw, and this hole can then also be covered by inserting a plastic plug into it.

For the transfer of its share of the weight of the cabinet to the hanger, mounting pins project horizontally from the outside surfaces of the perpendicular sides of the casing, and can be forced into preferably undersized bores in the cabinet sidewalls. Since mounting pins of this kind are provided on both of the perpendicular sides of the casing, the casing can be fastened either to the right or to the left sidewall of the cabinet.

It is furthermore recommendable to provide in the top of the casing vertical threaded bores for mounting screws, so that additional provision is made for attaching the casing to the roof of the cabinet.

In cases in which the roof of the cabinet does not extend far enough rearward to be flush with the rear edges of the sidewalls, but reaches only as far as the rear wall of the cabinet, the casing can alternatively be designed so as to have a flat flange on its side facing the cabinet rear wall, which flange can be placed flatly against the top of the roof and be fastened thereto. For this purpose this flange can best be provided with one or more bores through which mounting screws can be driven into the roof of the cabinet.

The casing of the hanger is preferably made by die casting from zinc alloy (Zamak), the mounting pins preferably being cast integrally with the casing. Alternatively, they can be in the form of separately made pins which can be driven into the side of the casing that is associated with the side wall of the cabinet; in this case it is desirable to make these pins of a resilient plastic, which then in a known manner can be provided with circumferential saw-tooth shaped ridges to assure an especially reliable fastening in the bores in the side wall of the cabinet.

Another advantageous embodiment of the hanger of the invention, whose throw for the adjustment of the space between the wall and the cabinet is considerably greater, to such an extent that the hook at the bottom end of the hook member can be brought further out towards the room wall from the rear edges of the side walls of the cabinet, and is thus visible from the side of the cabinet while the latter is being hung, is characterized by the fact that the perpendicular sides of the casing are joined together at their edges facing the rear wall of the cabinet by a crosspiece at least at their bottom end, in which crosspiece an opening is provided for an adjusting screw whose head rests on the crosspiece surface facing the rear wall of the cabinet, while its threaded shaft is in engagement with a correspondingly threaded thimble, which in turn is engaged with a threaded bore in the cam holder. The crosspiece on the room wall side of the known hanger is therefore eliminated, so that the cam holder as well as the hook member can swing further outwardly toward the room wall. The double threaded connection between the threaded shaft of the adjusting screw and the thimble on the one hand and between the thimble and the threaded bore in the cam holder on the other hand, thus permits the achievement of the desired greater angle of adjustment.

In a preferred embodiment of the invention, the threaded thimble has an external and an internal thread, the shaft of the adjusting screw being screwed into the internal thread and secured against being completely unscrewed out of this internal thread, while the external thread of the thimble is screwed into the internal thread of the bore in the cam holder and likewise is secured against complete withdrawal from this thread in the direction of the adjusting screw.

The securing of the adjusting screw against complete withdrawal from the threaded thimble is preferably accomplished by the fact that the internal thread of the thimble extends over only a portion of the length of the thimble, that the diameter of the unthreaded section of the thimble bore is greater than the outside thread diameter of the shaft of the adjusting screw, and that the free end of the adjusting screw guided into the unthreaded section of the thimble is provided with a radially projecting flange whose diameter is greater than the root diameter of the threaded shaft of the adjusting screw and smaller, or no more than approximately equal to the diameter of the unthreaded section of the thimble bore.

It is desirable that the radial flange be formed by an annular disk fastened on the end of the shaft of the adjusting screw, the annular disk being able to be riveted to the end of the shaft of the adjusting screw. The securing of the threaded thimble against unscrewing from the threaded bore in the cam holder can be accomplished in a similar manner by providing on the end of the thimble pointing away from the adjusting screw a radially projecting flange whose outside diameter is at least equal to the outside diameter of the threaded thimble. This flange is preferably made integral with the threaded thimble or is fastened thereto by upsetting.

The head of the adjusting screw is preferably sunk in an associated recess in the back of the casing of the hanger, and it is recommendable to make the head of the adjusting screw round or in the shape of a spherical section on its bottom facing the recess, and to make the associated recess surface of the opening in the back wall of the casing of a complementary round or spherical section shape.

Since the longitudinal central axis of the adjusting screw and thimble tilts as the angle of the cam holder and hook member changes, causing the head of the adjusting screw to change its elevation in the casing back, provision is made in accordance with the invention for the opening in the back of the casing for the adjusting screw to be in the form of a vertically disposed slot.

In an advantageous further development of the invention, the head of the adjusting screw is provided at its junction with the threaded shaft with a radially flaring flange which catches behind the sharp edge of the vertically disposed slot in the casing back. This flange therefore is supported against the casing back, thereby assuring that, when the head of the adjusting screw is rotated, the cam holder will be swung outwardly towards the room wall, and the adjusting screw will not instead be unscrewed out of the hole in the rear wall of the cabinet. To maximize the throw of the cam holder, it is furthermore recommended to provide adjacent the opening in the casing back for the adjusting screw a boss projecting toward the rear wall of the cabinet. This boss will then be located, when the hanger is in the proper position for fastening to the cabinet, in the correspondingly enlarged hole provided in the rear wall of the cabinet for access to the adjusting screw.

The above-mentioned hole in the cabinet back and the hole permitting access for the height adjustment of the hanger, are best concealed by a common cover which is preferably of a color matching that of the inside surface of the cabinet back.

The angle of movement of the cam holder and hence of the hook member can, if necessary, be made still greater by adding to the telescoping screw-threaded adjusting means composed of the adjusting screw and the thimble an additional thimble screwed onto the first thimble and in turn into the threaded bore. The design is then made such that the thimble has an external and an internal thread, the shaft of the adjusting screw being screwed into the internal thread and secured against complete withdrawal therefrom, and that the external thread of the thimble is screwed into an internal thread of the second thimble whose external thread is screwed into an internal thread in the cam holder and is also secured against complete withdrawal from this internal thread towards the adjusting screw.

Figure 2:
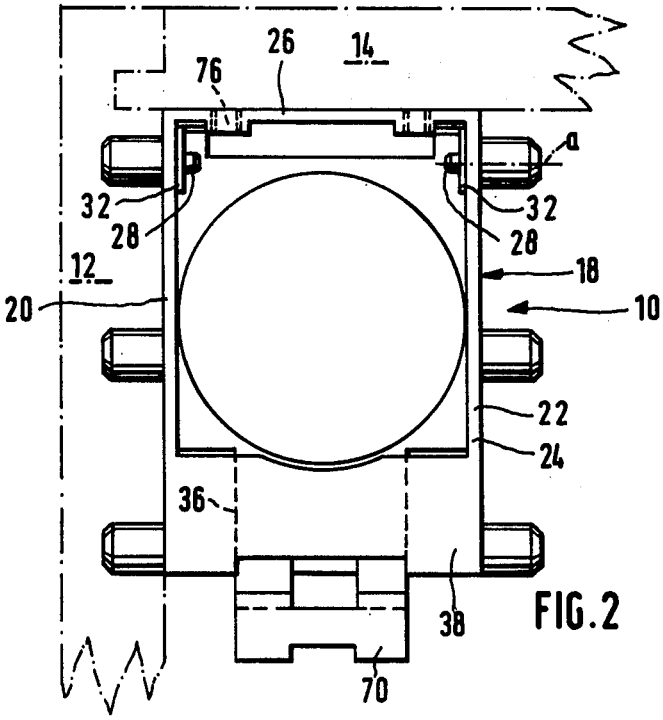
Figure 5:
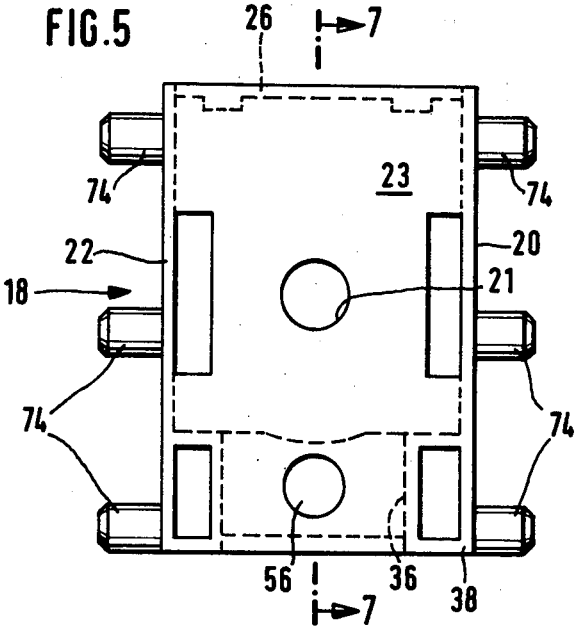
Figure 7:
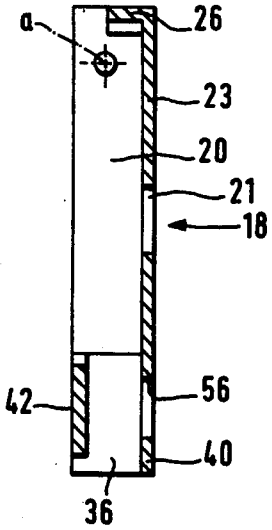
Figure 15:
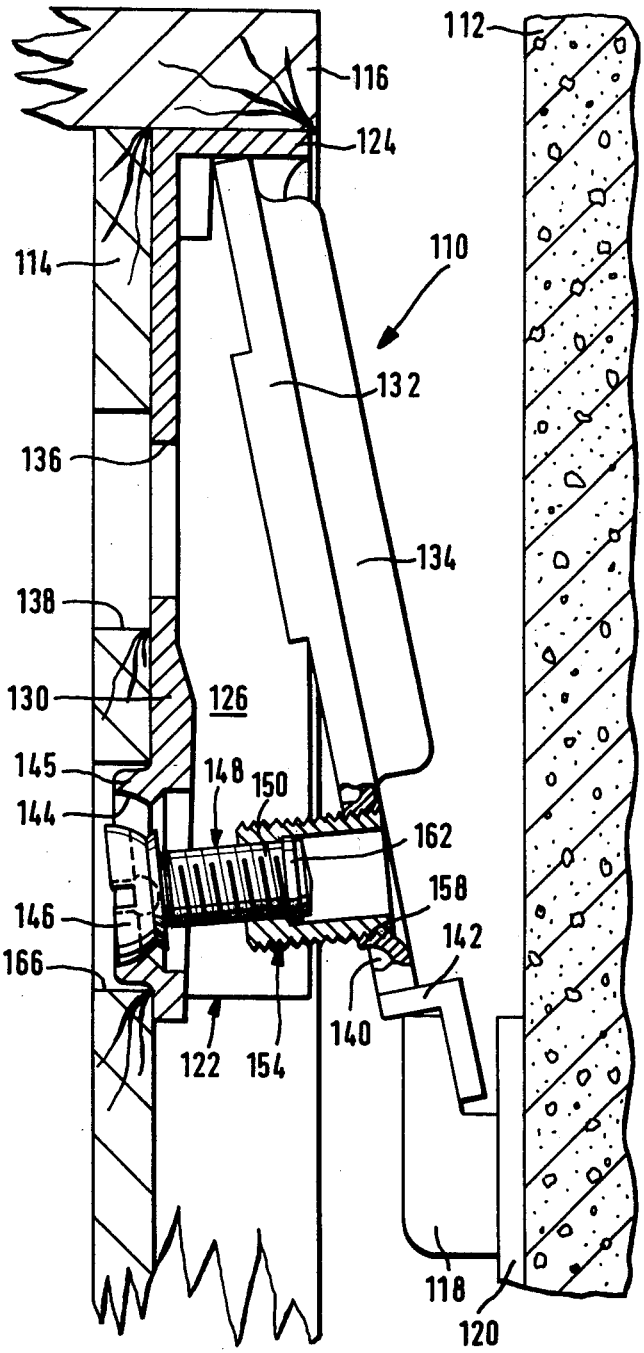
Figure 16:
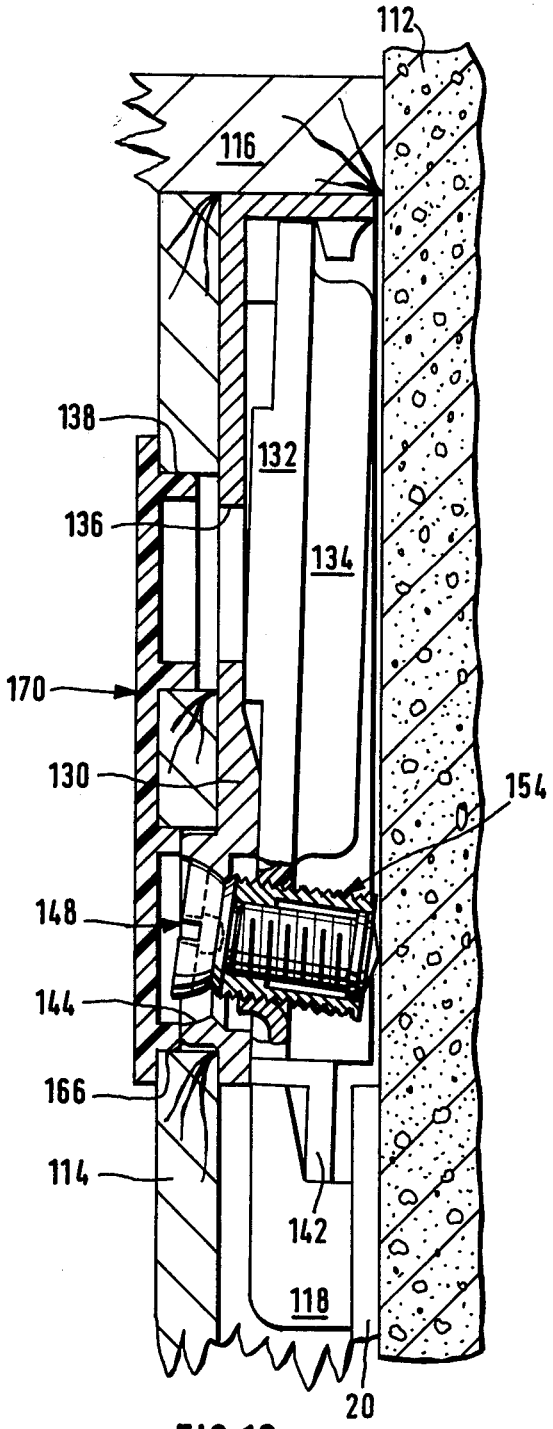
Figure 17:
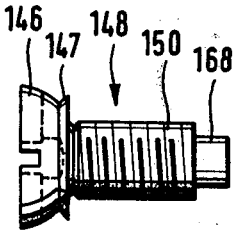
Figure 18:
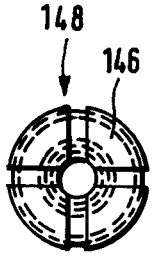
Figure 19:
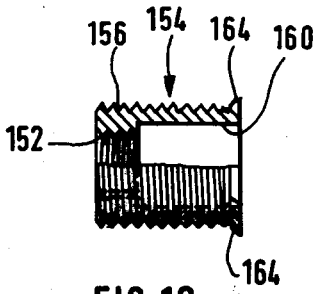
Figure 20:
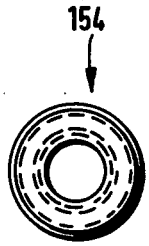
Figure 21:
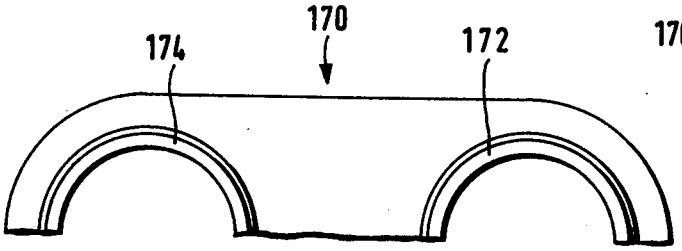
Figure 22:
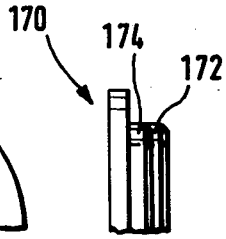

The invention is further explained in the following description of several embodiments, in conjunction with the drawings, wherein:

FIG. 1 is a front elevational view of a hanger constructed in the manner of the invention, FIG. 2 is a rear view of the hanger shown in FIG. 1, FIG. 3 is a side view in the direction of arrow 3 in FIG. 1, FIG. 4 is a cross section seen in the direction of the arrows 4—4 of FIG. 1, FIG. 4*a* is a side view, corresponding to FIG. 3, of an embodiment of the hanger of the invention, which differs with regard to the manner in which it is fastened to the roof of the cabinet, FIG. 5 is a front elevation of the casing of the hanger of FIGS. 1 to 4, FIG. 6 is a rear elevation of the casing shown in FIG. 5, FIG. 7 is a cross section seen in the direction of the arrows 7—7 of FIG. 5, FIG. 8 is a top plan view of the cam holder of the hanger shown in FIGS. 1 to 4, FIG. 9 is a cross section seen in the direction of the arrows 9—9 of FIG. 8, FIG. 10 is a partial cross section through the upper right corner of the cam holder, seen in the direction of the arrows 10—10 of FIG. 8, FIG. 11 is a view of the hook member of the hanger shown in FIGS. 1 to 4, FIG. 12 is a cross section seen in the direction of the arrows 12—12 of FIG. 11, FIG. 13 is a view of the cam for the height adjustment of the hook part relative to the cam holder, FIG. 14 is a cross section seen in the direction of the arrows 14—14 of FIG. 13, FIGS. 15 and 16 are each side views, partially in cross section along the vertical central longitudinal plane of a third embodiment of a hanger of the invention, FIG. 15 showing the position of the hook member during the hanging operation, and FIG. 16 the position after the correct establishment of the distance from the wall, FIGS. 17 and 18 are a side view and a front view, respectively, of the adjusting screw used in the hanger of FIGS. 15 and 16, FIGS. 19 and 20 are, respectively, a partially cross-sectional side view and an end view of a corresponding threaded thimble, and FIGS. 21 and 22 are, respectively, a bottom view and a side view of one-half of a cover for the holes provided in the rear wall of a hanging cabinet which is to be equipped with the hanger of the invention.

FIGS. 1 to 4 represent an embodiment, generally designated by the number 10, of the hanger of the invention, it being assumed that the location of the hanger is to be in the upper right corner of the back of a wall-hung cabinet, of which the corner portions of the side-wall 12 and of the roof 14 of the cabinet are indicated by the dash-dotted lines and, in FIG. 3, also the back wall 16 of the cabinet is indicated in dash-dotted lines. It is particularly apparent from the last-mentioned FIG. 3 that the hanger 10 is disposed in the interstice between the room wall (not shown) and the back wall of the cabinet.

Figure 6:
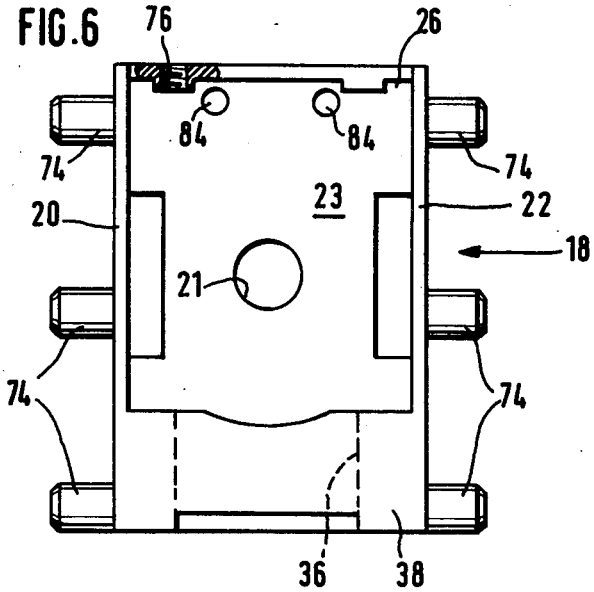

In the illustrated case, the hanger has a casing 18 made of die-cast metal, which is represented separately in FIGS. 5 to 7, and a substantially rectangular, box-like configuration of relatively shallow depth. This box is formed by two parallel, perpendicularly disposed sides 20 and 22 joined at the top by a horizontal member 26 and at the lower end by a lower member 38. The wall 23 constitutes the bottom of the box, and is to be placed against the back 16 of the wall-hung cabinet.

Between the perpendicular box sides 20 and 22 of the casing, a shallow, plate-like cam holder 24 (FIGS. 8 to 10) is articulated about an axis a located adjacent the upper, horizontal box side 26, being hung on two pins 28 press-fitted into bores in the vertical box sides 20 and 22 and engaging each in a bore 30 in ears 32 projecting from the cam holder. A prolongation 34 of reduced width projects from the lower transverse edge of the cam holder into an opening 36 in the lower, horizontal box side 38. This opening 36 is defined at the front and back by narrow crosspieces 40 and 42, crosspiece 40 being part of the back 23 of the casing. These crosspieces limit the excursion of the cam holder 24. In a shallow, circularly defined recess 44 in the cam holder 24, there is inserted a freely rotatable cam 46 (FIGS. 13 and 14) in whose face, which is exposed in the recess, a spiral groove is provided. A stud 50 provided with a screwdriver slot projects from the center of the cam 46 and serves for turning the cam 46.

The prolongation 34 of the cam holder 24, which is situated within the opening 36, has a threaded bore 52 into which there is threaded a headless screw 54 having rounded ends, whose length is such that it just fits between the inside surfaces of the walls 40 and 42. The headless screw 54 can be turned with a screwdriver through an opening 56 in the front wall 40, whereupon the cam holder 24 will be continuously swung backward or forward according to the direction in which the screw is turned.

On the cam holder 24 there is placed a planar section 58 of a hook member 60 (FIGS. 11 and 12) whose perpendicular lateral edges are guided for vertical displacement on the cam holder 24 while being secured by means of lateral guides 62 against being lifted away from the latter. A projection 64 extends toward the cam holder from the planar section 58 and engages the spiral groove 48 in the cam 46.

At its lower horizontal edge the planar section 58 is adjoined by a prolongation 68 which lies flat against the prolongation 34 of the cam holder 24 and is of such length that its free end will still project from the opening 36 when the hook member 60 is in its uppermost position relative to the cam holder 24.

An elongated opening 72 extending perpendicularly in the center of the planar section 58 and prolongation 68 of the hook member 60 accommodates the stud 50 of the cam 46 and the headless screw 54 threaded into the prolongation 34. Since the hook member 60 is fastened to the cam holder and yet longitudinally displaceable thereon, any rotation of the headless screw 54 will produce, simultaneously with the swinging movement of the mounting part, a swinging movement of the hook member, and thus of the hook 70 projecting from the bottom of the casing 18, which hook accordingly varies its distance from the back wall 16 of the cabinet, as indicated diagrammatically in FIG. 3. The variation of the distance of a cabinet from the wall is therefore accomplished by rotating the headless screw 54. For the height adjustment, however, the cam 46 is rotated by means of a screwdriver applied to the stud 50, an opening 21 being provided in the back 23 of casing 18 for this purpose. By means of the projection 64 engaging the spiral groove 48, the hook member 60 will be displaced upwardly or downwardly according to the direction in which the cam is turned. To illustrate this vertical displacement, FIG. 1 shows two positions of the hook member 60, one in solid lines and the other, second position, in dash-dotted lines.

The functional interaction between the mounting part which is articulated within the casing 18, and the hook member disposed for longitudinal displacement on the cam holder, is now clear. For the fastening of the casing 18 to the cabinet, mounting pins 74 horizontally projecting from the outer surfaces of the perpendicular box sides 20 and 22 are provided, the illustrated hanger 10 having three mounting pins 74 integrally cast on each side of the casing, which are able to be pressed into associated bores in the sidewall 12 of the cabinet.

Additionally, taps 76 are provided in the upper horizontal side 26 of the casing box 18 which is cut away at its upper left in FIG. 6 to show this. The casing 18 can thus also be mounted by means of screws 78 which are threaded through the roof 14 of the cabinet into the taps 76, as indicated in dash-dotted lines in FIG. 3. It can be seen that the hanger 10 is of symmetrical construction about its longitudinal central axis, so that it can be fastened either in the upper right-hand corner or in the upper left-hand corner of the cabinet.

In many wall-hung cabinets, the roof 14 is so much narrower than the sides that it leaves open the space between the rear wall of the cabinet and the wall on which the cabinet is to be hung. It is then impossible to fasten the hanger 10 to the roof 14 by means of screws 78 threaded into the taps 76 in the top 26 of the casing, because the roof of such cabinets does not extend all the way over the top end 26 of the casing. For such wall-hung cabinets, the variant hanger shown in FIG. 4*a* is provided, in which a flat flange 80 is formed integrally on the side of the casing that faces the rear wall 16 of the cabinet, and it can be set flush against the top of the roof 14 of the cabinet. The flange 80 is provided with one or more bores 82 through which screws can be driven downwardly into the roof 14.

The flange 80 with the bores 82 can be omitted, however, if the casing 18 is screwed to the back edge of the top board 14, in which case bores 84 are provided in the casing back 23 (FIG. 6) for the screws.

A third example of the embodiment of the hanger of the invention, designated in its entirety by the number 110, is shown in FIGS. 15 and 16. This hanger is fastened on that side of the rear wall 114 of the cabinet which confronts the room wall 112, and it abuts against the bottom of the roof 116 of a cabinet where the roof projects beyond the cabinet back wall 114. FIG. 15 shows the positions of the working parts of the hanger 110 while the cabinet is being hung on the upturned portion 118 of a supporting rail 120 fastened to the room wall, and FIG. 16 shows their positions after the hanging operation is completed.

Since the hanger 110 is largely the same in its conception and operation as the hanger 10 previously described, only the features devised in accordance with the invention will be described in detail hereinafter, and the previously discussed embodiments can be consulted as to the characteristics common to both embodiments, e.g., as to the means for the height adjustment of the hanger.

The shallow casing box 122 of the hanger 110 is formed by an upper box side 124 and two perpendicular box sides 126, whose edges facing the cabinet rear wall 114 are joined together by the back 130 of the box. Between the perpendicular box sides 126, a shallow, dish-like cam holder 132 is mounted so as to be able to swing about an axis situated adjacent the upper, horizontal box side 124. In its central, dished area 134 the rotatable cam (not shown) is mounted, which can be rotated with a tool passed through a bore 136 in the back 130 and a bore 138 in the rear wall 114 of the cabinet. A projection of the vertically displaceable hook member 140 is engaged in the spiral groove of the cam, the bottom part of the hook member being provided at its bottom end with the hanging hook 142.

In the bottom portion of the casing box 122 there is provided in the wall 30 a vertically elongated opening 144 having spherically hollowed edges facing the rear wall 114 of the cabinet, in which an adjusting screw 148 is held by its head of complementary spherical configuration, the threaded shaft 150 of the adjusting screw being screwed into an internal thread 152 of a thimble 154 which in turn has an external thread 156 which is engaged in a threaded bore 158 in the cam holder 122. The internal thread 152 of the thimble 154 extends over only a portion of its length, while the unthreaded section 160 is larger in diameter than the outside thread diameter of the shaft 150 of the adjusting screw 158. A ring 162 fitted to the unthreaded section 160 is riveted onto the free end of the threaded shaft 150, thereby enabling the threaded shaft 150 to be unscrewed only until the ring 162 engages the shoulder at the transition between section 160 and the threaded section.

On the end opposite the adjusting screw the threaded thimble 154 has a radially projecting flange 164 which projects slightly beyond the outside diameter of the thread 156. This assures that the thimble can be unscrewed only until the flange 164 engages the start of the threaded bore 158. The shaft 150 of the adjusting screw and the thimble 154 thus constitute a telescoping screw element resulting in a considerably greater throw for the purpose of swinging the mounting part 132 and hence the hook member 140 than would be possible with an adjusting screw alone. Thus it can be seen, for example, in FIG. 15 that the hanging hook 142 at the bottom end of the hook member 140 can, as a result, be swung outwardly to such an extent that it will be outside of the rear edge of the roof 116 (and thus also outside of the rear edges of the side walls of the cabinet). Thus it is possible during the hanging process to observe from the cabinet side whether the hanging hook 142 is actually brought into engagement with the upturned portion 118 of the supporting rail 120.

If the hook is so engaged, the head 146 of the adjusting screw 148 can be turned with a screwdriver inserted through a bore 166 provided in the rear wall 114 of the cabinet, whereupon first the shaft 150 is screwed into the thimble 154 until the end of the latter abuts the underside of the head 146. As turning continues, the thimble 154 then is driven into the bore 158, the cam holder 132 being pulled toward the back 130, thereby drawing the cabinet toward the room wall 112 until the rear edge of the roof 116 or the rear edges of the sidewalls are brought into contact with the room wall. This position is represented in FIG. 16. The opening 144 is formed in a boss 145 of the casing back 130, this boss projecting toward the rear wall 114 of the cabinet and entering into the bore 166, thereby maximizing the throw of the screw element composed of the adjusting screw 148 and the threaded thimble 154.

In FIGS. 17 and 18 the adjusting screw 148 and in FIGS. 19 and 20 the thimble 154 are represented separately, the adjusting screw being shown before the ring 162 is installed and riveted onto the end stud 168 on the free end of the threaded shaft 150, since such riveting cannot be performed until after the hanger 110 has been assembled, when the adjusting screw 148 is threaded through the opening 144 into the thimble 154 which has first been threaded into the threaded bore 158 in the cam holder 132. It can also be seen that the head 146 of the adjusting screw 148 is also provided at the bottom of its rounded underside adjacent the threads with a radially projecting circular flange 147 which catches on the rim of the opening 144 in the casing back 130. When the cam holder, and with it the hook member, swings outwardly, the circular flange 147 therefore is supported against the back 130 of the hanger 110.

In the face of the adjusting screw head 146, which is accessible through the bore 166 in the rear cabinet wall 114, there is provided, as seen in FIG. 18, a cross-slotted recess for engagement with a Phillips screwdriver. Alternatively, a common single slot or a hexagonal socket (for an Allen wrench) could be provided.

FIGS. 21 and 22 are fragmentary views, i.e., views which are to be considered as symmetrical about the longitudinal central axis, of a cover 170 for closing the bores 136 and 166, which cover can be installed from the inside of the cabinet. In the illustrated case it is a planar plastic injection molding of a color corresponding to the colors of the inside of the back wall of the cabinet, and it has two projecting rings 172 and 176 corresponding to the respective diameters of bores 136 and 166, which can be pressed to fit tightly into the bores 136 and 166, respectively, and thereby hold cover 170 in place in the manner illustrated in FIG. 16.

Variations and further developments of the special embodiment described above can be made within the scope of the invention. For example, the throw of the cam holder 132 and thus of the hook member 140 can be increased still further if the telescoping screw adjusting element composed of the adjusting screw 148 and the threaded thimble 154 is augmented by an additional threaded thimble threaded onto the thimble 154 and then into the threaded bore 158.

We claim:

1. A hanger for a wall-hung cabinet or the like, having: a casing adapted to be fastened in a rearward part of a cabinet and a hook member adapted to be hung onto a wall hook or a wall-mounted rail, and displaceably disposed at right angles to a wall and also perpendicularly parallel to the wall, said casing being in the form of a substantially rectangular frame of relatively shallow depth and having a frame with frame elements disposed substantially vertically in their properly fastened position, a mounting part for mounting said hook member being mounted between said frame elements so as to be able to swing about a substantially horizontally disposed axis and be locked at selectable intermediate positions, said hook member being disposed on the mounting part for displacement in a substantially vertical direction, and a cam disposed between the mounting part and the hook member, said cam being mounted rotatably at the mounting part and having a spiral groove in a flat side thereof facing the hook member, and a projection of the hook member engaging said groove.

2. A hanger according to claim 1, wherein said mounting part is in the form of a flat plate substantially filling the open part of the casing enclosed by the frame and has a recess in which said cam is fitted, said hook member having a planar, plate-like section disposed over the recess and guided in lateral longitudinal guides on the mounting part so as to be secured against being lifted away from the mounting part.

3. A hanger according to claim 2, wherein said cam has on said flat side thereof facing the hook member a relatively short, projecting stud adapted for engagement by a tool and passing through a slot extending in the direction of displacement in the hook member.

4. A hanger according to claim 2, wherein said frame has two essentially horizontally disposed frame elements, the lower one thereof having a perpendicular through-opening closed at the front and back by parallel thin front and back transverse walls respectively, a first prolongation of the plate-like section of the hook member passing through said opening, said prolongation being constructed as a hanging hook at its lower end projecting from the casing.

5. A hanger according to claim 3, wherein said frame has two essentially horizontally disposed frame elements, the lower one thereof having a perpendicular through-opening closed at the front and back by parallel thin front and back transverse walls respectively, a first prolongation of the plate-like section of the hook member passing through said opening, said prolongation being constructed as a hanging hook at its lower end projecting from the casing.

6. A hanger according to claim 4 or 5, wherein said mounting part has a second prolongation projecting into said through-opening, the threaded shaft of a screw being screwed into a threaded bore provided within the through-opening in said second prolongation, said threaded shaft passing through said slot in the overlying first prolongation of the hook member and resting with its extremities against the inside surfaces of said transverse walls, the front transverse wall on the hook member side being provided with an opening for the engagement of a tool with the screw.

7. A hanger according to any one of claims 1 to 5, comprising mounting studs projecting horizontally on the outside surfaces of said vertically disposed frame elements.

8. A hanger according any one of claims 1 to 5, wherein essentially vertically extending threaded bores for mounting screws are provided in the upper horizontally extending frame element of the casing.

9. A hanger according to any one of claims 1 to 5, comprising a flat flange projecting from the upper horizontal frame element of the casing, on the side to face the back wall of the cabinet to be hung, said flat flange being adapted to be set flatly against a top flat side of a top board of the cabinet to be hung and to be fastened to the top board.

10. A hanger according to claim 9, wherein said flat flange is provided with at least one bore for fastening means to be driven into the top board of the cabinet to be hung.

11. A hanger according to claim 7, wherein said casing is made of die-cast zinc alloy (Zamak).

12. A hanger according to claim 11, wherein said mounting pins are cast integrally with the casing.

13. A hanger according to claim 1, wherein the vertically disposed frame elements are joined together at least in the bottom area by a transverse wall only at their edges facing a back wall of a cabinet to be hung, an opening provided in said transverse wall for an adjusting screw whose head abuts against the transverse wall on the surface facing the back wall while its threaded shaft is in threaded engagement with a threaded thimble which in turn is in threaded engagement with a threaded bore in said mounting part.

14. A hanger according to claim 13, wherein said threaded thimble has an external and an internal thread, the shaft of the adjusting screw being screwed into the internal thread and secured against becoming completely unscrewed out of the internal thread, and the external thread of the threaded thimble being screwed into a counterthread in the mounting part and also being secured against being completely unscrewed from the counterthread in the direction toward the adjusting screw.

15. A hanger according to claim 14, wherein the internal thread of the threaded thimble extends over only a portion of the length thereof, the diameter of the unthreaded portion of the thimble bore being larger than the outside thread diameter of the shaft of the adjusting screw, and the free end of the adjusting screw guided in the unthreaded portion of the threaded thimble being provided with a radially projecting flange whose diameter is larger than the thread root diameter of the shaft of the adjusting screw and not larger than the diameter of the unthreaded portion of the thimble bore.

16. A hanger according to claim 15, wherein the radially projecting flange is formed by a flat ring fastened on the end of the shaft of the adjusting screw.

17. A hanger according to claim 16, wherein the flat ring is riveted to the end of the shaft of the adjusting screw.

18. A hanger according to any one of claims 14 to 17, wherein the threaded thimble has at its end pointing away from the adjusting screw a radially projecting flange whose outside diameter is at least equal to the thread diameter of the external thread of the threaded thimble.

19. A hanger according to any one of claims 14 to 17, wherein the head of the adjusting screw is sunk in an associated recess in the transverse wall.

20. A hanger according to claim 19, wherein the head of the adjusting screw is of a rounded or spherical segmentshaped configuration on its bottom side associated with the recess, and the associated recess surface of the opening in the transverse wall is of a complementary rounded or spherical segment-shaped configuration.

21. A hanger according to any one of claims 13 to 17, wherein the opening for the adjusting screw in the transverse wall is in the form of a slot running in substantially vertical direction.

22. A hanger according to claim 21, wherein the head of the adjusting screw has between its rounded bottom and the threaded shaft a radially broadened annular flange which catches behind the edge defining the slot on the mounting part side of the transverse wall.

23. A hanger according to any one of claims 13 to 17, wherein the transverse wall has adjacent the opening for the adjusting screw a projection projecting toward a back wall of the cabinet to be hung, in which projection the opening is disposed.

24. A hanger according to any one of claims 13 to 17, comprising a cover concealing bores in the cabinet back wall and for providing access to adjusting elements of the hanger.

25. A hanger according to claim 13, wherein the threaded thimble has an external and an internal thread, the shaft of the adjusting screw being screwed into the internal thread and secured against being turned completely out of the internal thread, and the external thread of the threaded thimble being screwed into a counterthread in the interior of an additional threaded spindle whose external thread is screwed into a counter thread bore in the mounting part and is likewise secured against being completely unscrewed out of the thread in the direction toward the adjusting screw.

* * * * *